United States Patent [19]

Cook

[11] Patent Number: 4,666,474

[45] Date of Patent: May 19, 1987

[54] ELECTROSTATIC PRECIPITATORS

[75] Inventor: Edward Cook, Florissant, Mo.

[73] Assignee: Amax Inc., Greenwich, Conn.

[21] Appl. No.: 895,556

[22] Filed: Aug. 11, 1986

[51] Int. Cl.[4] ..... B03C 3/08; B03C 3/41

[52] U.S. Cl. ..... 55/137; 55/147; 55/151

[58] Field of Search ..... 55/137, 147, 148, 140, 55/151

[56] References Cited

U.S. PATENT DOCUMENTS

| | | | |
|---|---|---|---|
| 2,382,254 | 8/1945 | Penney et al. | 55/137 |
| 2,588,111 | 3/1952 | Hanneman | 55/147 X |
| 2,922,883 | 1/1960 | Giaimo, Jr. | 55/147 X |
| 3,606,734 | 9/1971 | Dyla | 55/151 X |
| 4,106,919 | 8/1978 | Lagerdahl | 55/147 |
| 4,263,023 | 4/1981 | Schminke | 55/137 X |
| 4,434,416 | 3/1984 | Testone | 55/151 X |
| 4,516,991 | 5/1985 | Kawashima | 55/147 X |

FOREIGN PATENT DOCUMENTS

| | | | |
|---|---|---|---|
| 2045647 | 11/1980 | United Kingdom | 55/147 |

*Primary Examiner*—Kathleen J. Prunner

*Attorney, Agent, or Firm*—Michael A. Ciomek; Eugene J. Kalil

[57] ABSTRACT

An electrostatic precipitator is provided comprising a plurality of spaced apart vertically extending collector plates with an array of vertically extending ionizer wire rods disposed in a space between each of the collector plates. The improvement resides in an ionizer wire rod construction made of a heat resistant alloy, one end portion of which terminates into a plurality of closely packed helically formed loops. The size of the loops as a unit is sufficient to hook onto and freely hang from a connecting portion of an ionizer frame, the other end portion of the rod being also helically formed into a plurality of closely packed loops which are coupled as a unit to an end loop of a helically and tightly wound coil spring of a heat-resistant alloy. The tightly wound coil spring comprises a plurality of active turns, with each active turn adjacently touching the other in the unstretched condition, the coil spring being cylindrically shaped and having a length such as to provide a tension on the ionizer wire of at least about 30 pounds when substantially the total length of the cylindrical coil is activated by stretching to provide and maintain said tension, the coil spring having a connecting loop at its other end for coupling to an opposite portion of the ionizer frame.

15 Claims, 6 Drawing Figures

ELECTROSTATIC PRECIPITATORS

This invention relates to electrostatic precipitators and to an improved emitter ionizer wire construction.

STATE OF THE ART

In conventional precipitators there is a tendency for electrode wires (i.e., emitter ionizer wire) to break and fracture at their point of anchorage due to fatigue.

As pointed out in U.S. Pat. No. 2,866,517, in electrical precipitator operation, dust and other types of precipitates collect on discharge electrodes and are removed by vibration and rapping means which cause flexing and vibration of the electrodes.

For example, in the case where discharge electrodes take the form of elongated flat ribbons or bands of an electrically conductive material, it has been observed that flexing and vibration of such ribbon type electrodes produce substantial stresses which are normally concentrated along the attachment edges of the ribbon or band. The same phenomenon occurs where the electrode is a wire. U.S. Pat. No. 2,866,517 proposes a modified mounting and support structure for the discharge electrode to minimize this problem.

However, the discharge electrode material during use tends to elongate and sag at elevated temperatures due to creep. To avoid this, stress is continually applied to the electrode by means of weights to keep discharge electrode under stress. U.S. Pat. No. 2,867,287 also proposes a modified mounting or support for discharge electrodes in which the electrode structure includes a flexible anchorage means, such as spring means. While such support structures appear to be an improvement over other types of anchorage means, the specific anchorage structure employed still had much to be desired.

OBJECTS OF THE INVENTION

It is an object of the invention to provide an electrostatic precipitator having improved operational life in the field.

Another object is to provide an improved emitter ionizer wire construction.

These and other objects will more clearly appear when taken in conjunction with the following disclosure, the claims and the accompanying drawings.

IN THE DRAWINGS

SUMMARY OF THE INVENTION

Figure 1:
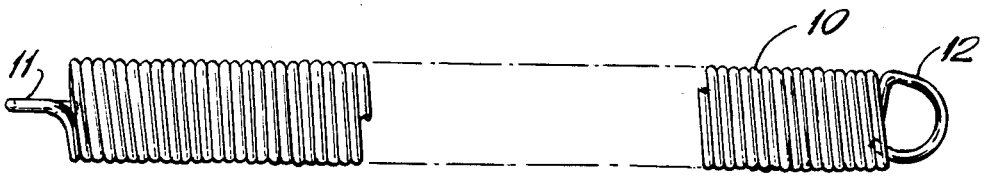
FIG. 1 is illustrative of a cylindrically-shaped coil spring used as an element in combination with an emitter ionizer wire.

One embodiment of the invention resides in an improved ionizer wire construction for an electrostatic precipitator. Stating it broadly, the ionizer wire rod is preferably comprised of a heat resistant alloy, one end portion of the rod terminating helically into a plurality of closely packed loops, e.g., two loops, sufficient to provide a free tail portion which is bent and wrapped around the wire rod adjacent to the loops, the size of the loops as a unit being sufficient to hook freely onto a connecting portion of an ionizer frame. The other end portion of the rod is also helically formed into a plurality of closely packed loops (e.g., two loops) which are coupled as a unit to an end loop of a helically and tightly wound coil spring of a heat-resistant alloy.

The tightly wound coil spring comprises a plurality of active turns with each active turn adjacently touching the other in the unstretched condition, the coil spring being cylindrically shaped and having a length such as to provide a tension on the ionizer wire of at least about 30 pounds when substantially the total length of the cylindrical coil is activated by stretching to provide and maintain the desired tension, the coil spring having a connecting loop at its other end for coupling to an opposite portion of the ionizer frame.

In a preferred embodiment, the ionizer wire rod has a diameter of about 0.05 to 0.125 inch, and the coil spring has a stretch rate of about 3 to 10 pounds per inch of original coil length when stretched. The cylindrical coil spring may have a diameter of about ½ to 1¼ inch, and is designed to provide a total stress on each of the ionizer wires ranging from about 30 to 50 pounds when mounted in the stretched condition.

A preferred stretch rate of the spring ranges from about 4 to 6 pounds per inch of original spring length when the ionizer wire is mounted in the stretched condition, the total stress on the ionizer wire rod preferably ranging from about 35 to 40 pounds.

The rod and spring may both be made of heat resistant alloy, the alloy being selected from the group consisting of nickel-base and iron-base alloys. Such alloys are preferred where the temperature of the electrostatic precipitator reaches 600° F. or higher, particularly where the precipitator is used to remove flue dust resulting from metallurgical operations.

The diameter of the wire from which the spring is made may also range from about 0.05 to 0.125 inch.

The advantage of using a plurality of end loops on the ionizer wire as connecting means to the ionizer frame and to the springs is that failure by fatigue at such connections is substantially reduced.

Materials used for the ionizer wire and the springs are disclosed in Volume 1 of the Metals Handbook, Ninth Edition (Published by the American Society for Metals, 1978), reference being made to pages 283 to 292. As stated at page 283, extension springs normally are close wound, usually with a specified initial tension and, because they are used to resist pulling forces, are provided with hook or loop ends to fit the specific application.

Stainless steels are the preferred iron-base alloys and may include Type 302 stainless consisting essentially of about 17% to 19% Cr, about 8% to 10% Ni and the balance essentially iron by weight. Another steel is Type 316 which contains by weight about 16% to 18% of Cr, about 10% to 14% Ni, about 2% to 3% Mo and the balance essentially iron. This steel is particularly preferred as spring and rod material. It has good heat resistance and greater corrosion resistance than Type 302 stainless and also good spring temper at temperatures in the neighborhood of about 600° F.

Another stainless steel is Type 631, otherwise referred to as 17-7 PH steel. This steel contains by weight about 16% to 18% Cr, about 6.5% to 7.75% Ni, about 0.75% to 1.5% Al and the balance essentially iron. This steel also has good spring temper at the aforementioned temperature.

Nickel-base alloy springs include an alloy identified by the trade mark Inconel 600 which contains approximately by weight 76% Ni, 15.8% Cr, about 7.2% Fe and the balance residuals. This alloy has good corrosion resistance at elevated temperatures, e.g., 600° F., and also retains its spring temper at such temperatures due to its age hardening properties.

Another nickel-base alloy is one known by the trade mark Inconel X-750 which contains approximately 73% Ni, 15% Cr, 6.75% iron and the balance age hardening elements. This alloy in the age hardened condition has good spring temper at elevated temperature.

Another embodiment of the invention is directed to an electrostatic precipitator comprising a plurality of spaced vertically extending steel collector plates mounted in a housing in substantially parallel relationship. The precipitator also includes a plurality of ionizer wire frames each mounted between said collector plates and characterized by a top and a bottom frame portion; each having a spaced array of vertically extending ionizer wire rods, the frames being coupled for electrical excitation opposite in charge to said collector plates which are grounded. Each of the wire rods have connecting means at each end thereof in the form of a plurality of tightly wound closely packed loops sufficient to provide a free tail portion extending from said closely packed loops and wrapped around said wire rod adjacent said loops, one end of the wire rod being freely coupled via the loops as a unit to the top portion of each frame with the other end thereof freely coupled via the loops as a unit to one end of a helically tightly wound cylindrically shaped coil spring, which spring at its other end is coupled under tension to the lower or bottom portion of the frame. The length of the coil spring and the diameter of the wire forming the spring in the cold worked tempered condition are such as to provide a tension on the ionizer rod of at least about 30 pounds when substantially the total length of the helically wound coil spring is mounted on the frame in the stretched condition.

DETAILS OF THE INVENTION

A typical spring employed in carrying out the invention is illustrated in FIG. 1, the helically coiled spring 10 having a diameter of about $\frac{7}{8}$ of an inch and a length, excluding spring loops 11, 12, of about 7.5 inches and from the extreme ends of the loops a length of about 8.25". The spring is preferably produced from spring temper Type 316 stainless steel wire of diameter of about 0.105 inch. As will be noted from FIG. 1, the spring is tightly wound with the turns in very close pack relationship, the spring comprising, for example, approximately 65 active turns, the spring when stretched having a spring rate of about 6 lbs/inch of original spring length. The spring in the stretched condition is shown in FIG. 2, the spring being attached to ionizer wire rod 13 which is coupled to spring loop 12 via double loop 14 of the ionizer wire having a freely extending tail portion 14A which has been bent or wrapped around rod 13, the opposite end of rod 13 also terminating into a double loop 15 having a freely extending tail portion 15A wrapped around rod 13.

Figure 2:
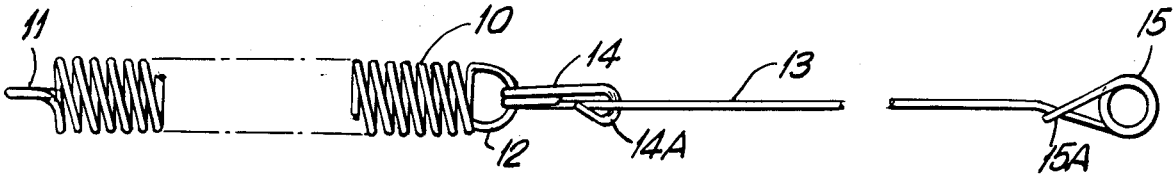
FIG. 2 depicts the combination of an ionizer wire and spring element showing the spring in the stressed condition.

In one embodiment, the extended or stretched length of spring in FIG. 2 when installed is about 1 foot - 2 inches from end of spring loop 11 to end of spring loop 12, as compared to the unstretched length of about 8.25 inches, the stretch amounting to approximately 70% of the original coil length. In this embodiment, the combined stretch length of spring and rod is about 10 feet - 2 inches from spring loop 11 to double loop 15 of the rod. The total length prior to stretch being approximately 9 feet - $8\frac{3}{4}$ inches.

Figure 3:
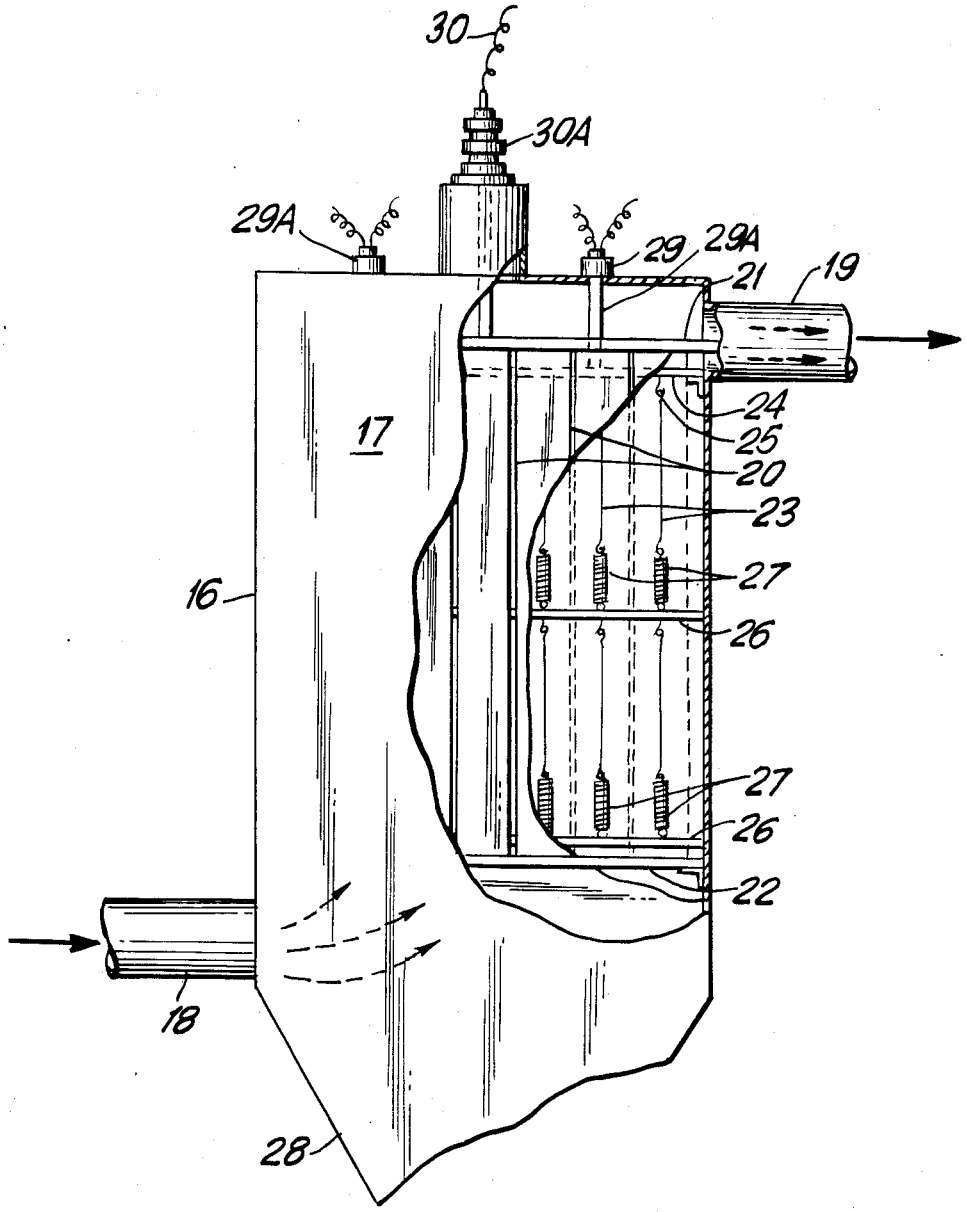
FIG. 3 is a schematic of one embodiment of an electrostatic precipitator partially broken away to reveal collector plates and an assembly of ionizer wires making up the main elements of the precipitator.

FIG. 3 is a schematic of one embodiment of an electrostatic precipitator 16 comprising a housing 17 with gas inlet means 18 and gas exit means 19, the housing being partially broken away as shown to reveal collector plate elements 20 coupled to upper and lower frame members 21, 22, the collector plates being partially broken away to reveal emitter ionizer wires 23 behind the plates, each wire being hooked to upper frame member 24 via hook 25 and lower frame member 26 via spring 27, the springs 27 being hooked to lower frame or mid-frame member 26. Frame member 24 is electrically coupled to a source of electricity 30 via insulated mounting 30A.

The ionizer wires comprise two sets, one above the other as shown, one group being coupled between frame members 24, 26 and the other between frame members 26, 26. The term "upper and lower ionizer frame members" is meant to include a mid-frame member which can serve as an upper or lower frame member.

The lower part of housing 17 extends to a hopper 28 which receives the precipitated dust. Rapper means 29, 29A are provided to vibrate the frame members supporting ionizer wire rods 23 via insulated upper arms 29A attached to frame member 24 as shown. Rapper means not shown are generally used to vibrate or shake the frame supporting the collector plates.

Figure 4:
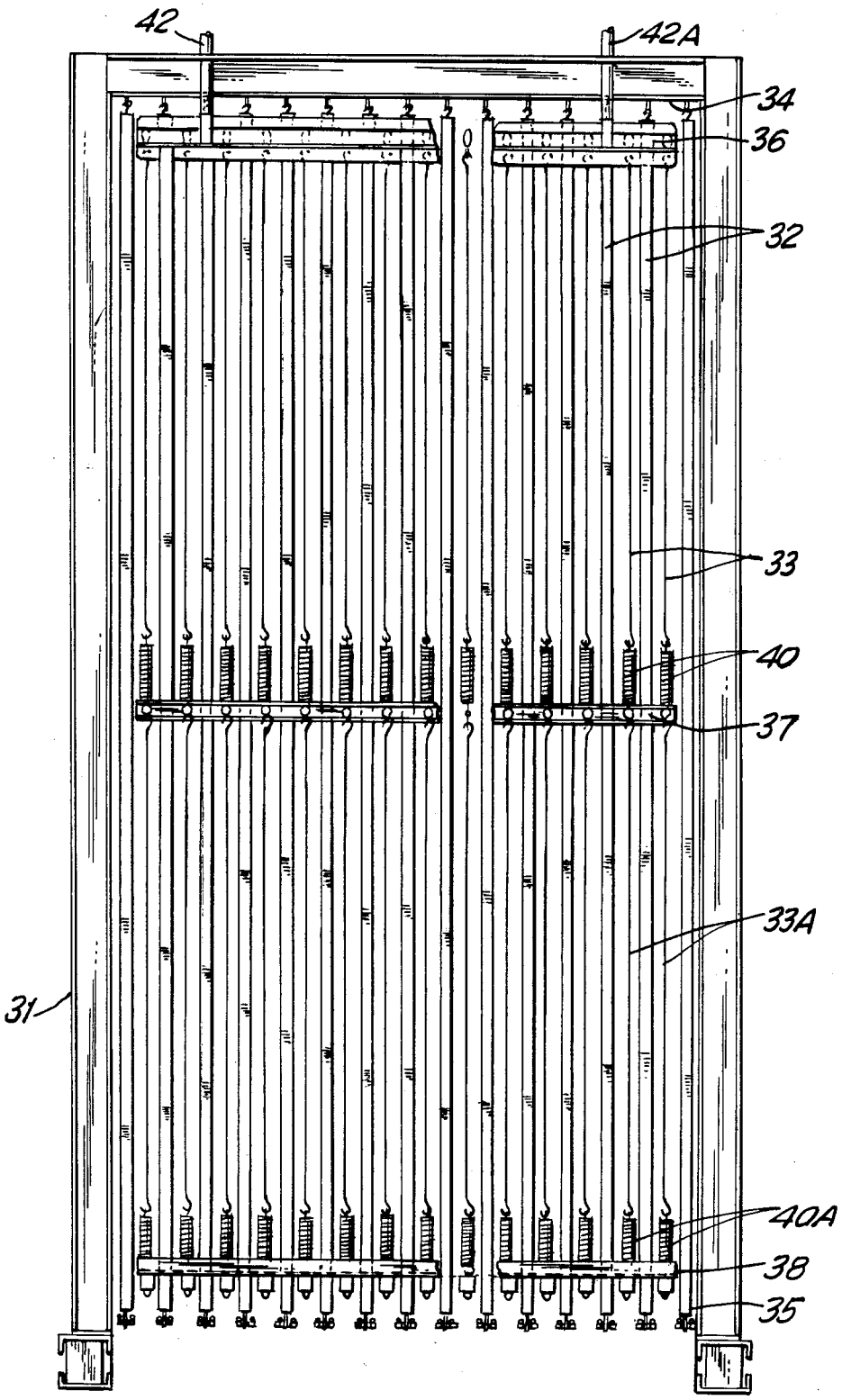
FIG. 4 is a side cross-section of another embodiment of an electrostatic precipitator showing the arrangement details of the emitter ionizer wires and the elements making up the collector plates.

A more detailed schematic is shown in the embodiment of FIG. 4 which is a cross section of a housing 31 showing in elevation an alternate arrangement in parallel of collector plates 32 and ionizer wire rods 33. The collector plates 32 extend from the top 34 of the housing 31 to the bottom thereof at 35, while the alternately ranged wire rods 33, 33A are disposed and attached between upper, intermediate and lower frame portions 36, 37, 38 using coupling hooks as shown.

With regard to ionizer wires 33, they extend from frame 36 to frame portion 37 via connecting springs 40 in the one instance and from frame portion 37 to frame portion 38 via connecting springs 40A.

The ionizer wire rod frame members are vibrated via rapper means 42 and 42A as shown, the spring members being disposed at the lower end of the ionizer wire, this arrangement being the more preferred use of the springs.

Figure 5:
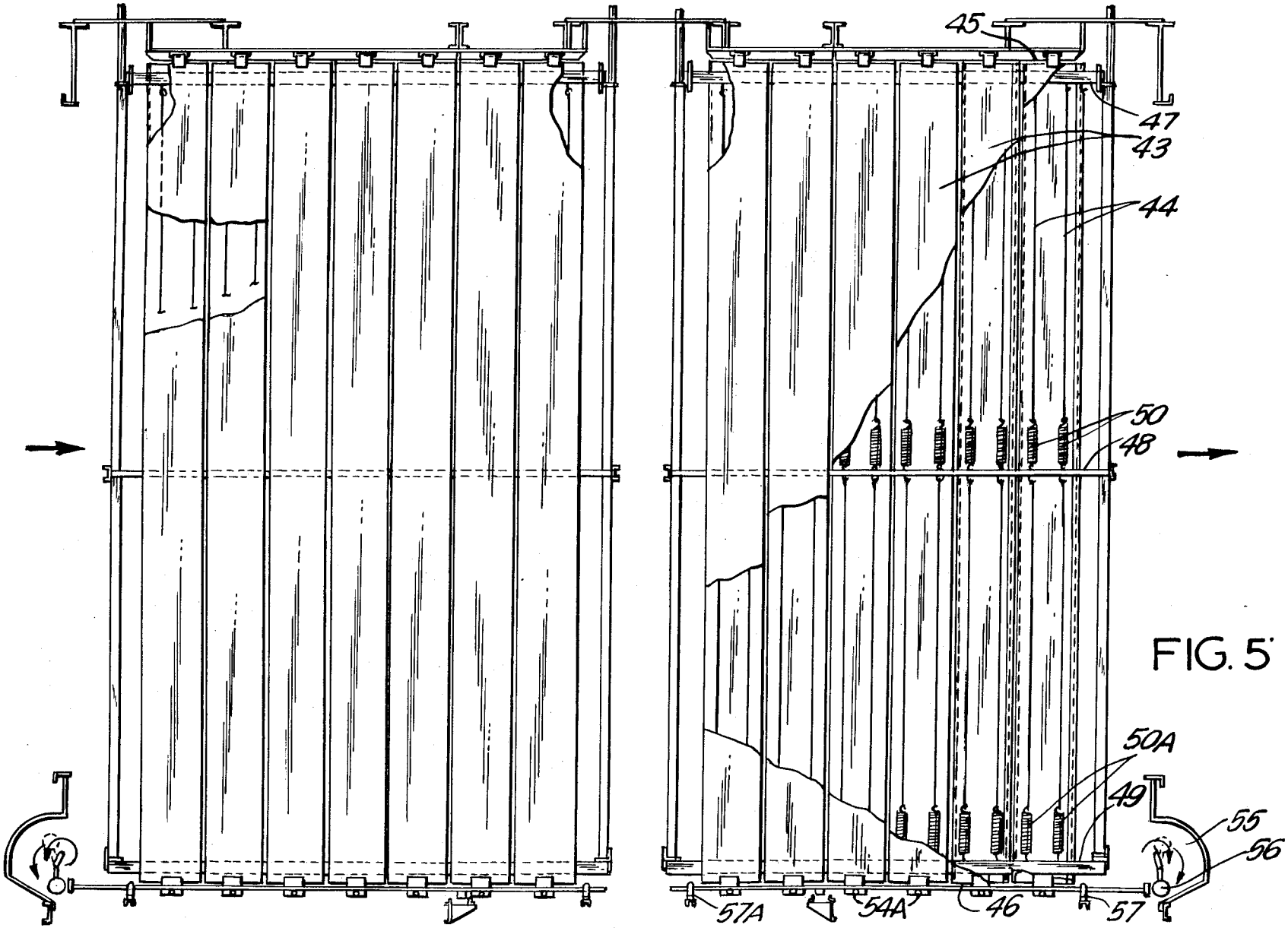
FIG. 5 is a front view of the inner construction of the electrostatic precipitator along the lines of FIG. 4 with the collector plates partially broken away showing a two-story arrangement or two sets of the emitter ionizer wires one above the other.

FIG. 5 is illustrative of a side-by-side arrangement of a collector plate-ionizer wire rod assembly which is supported in a housing not shown. The assembly is partially broken away to show ionizer wire rods 44 disposed behind collector plates 43, the collector plates being supported between top frame member 45 and lower frame member 46, the ionizer wire rod 44 being supported between frame member 47 and intermediate frame member 48 and between frame member 48 and member 49, and coupled thereto at the bottom end via springs 50 and 50A, respectively, as shown. Two ionizer wires are associated with each collector plate element.

Figure 6:
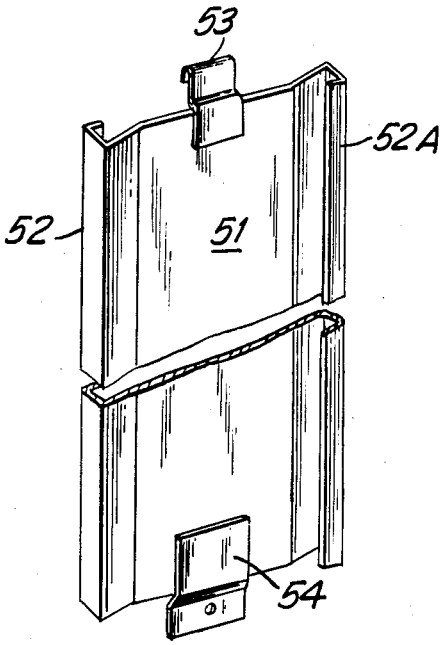
FIG. 6 is a detailed rendition of one embodiment of a collector plate element of the type shown in FIGS. 4 and 5.

A detail of the collector plate elements is shown in FIG. 6, the element 51 being formed of mild steel strip with the longitudinal edges 52, 52A being cold formed to provide a stiffened flanged structure as shown. Hook means 53 is provided at the top thereof for hooking onto the top frame member 45 fixed within the housing (FIG. 5), and means 54 at the bottom thereof for attachment to the bottom frame portion 46 of the housing.

Referring to FIG. 5 which shows a side-by-side arrangement of two collector plates/ionizer wire rod assemblies, it will be noted that the collector plate elements 43 are connected to the bottom frame member 46 via tongue or bracket 54A which corresponds to bracket 54 of FIG. 6. The connection is also shown in the side view of FIG. 5 in which the tongue or bracket 54A is shown passing through frame member 46 and held thereby. The term "upper and lower frame member" holding the collector plate elements is meant to include all the frame members alternately arranged as shown in FIG. 4.

Referring back to FIG. 5, a plate rapper mechanism 55 is shown at the side of the lower frame portion comprising a pivotally mounted hammer 56 (actuated by means not shown) striking the end of frame 46 as shown, the frame being supported by mounts 57 and 57A. The end of the frame is struck on an intermittent basis to dislodge the collected dust.

Tests carried out experimentally in the field under actual conditions for a period of over about two years resulted in a markedly improved life of the ionizer wire—spring assembly, during which period there was an occasional wire failure as compared to consistent wire failures in a much shorter time period when the novel spring support of the invention was not used.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. In an electrostatic precipitator comprising a plurality of spaced apart vertically extending collector plates with an array of vertically extending ionizer wire rods disposed in a space between each of said collector plates, an improved ionizer wire rod construction comprising:

an ionizer wire rod of a heat resistant alloy, one end portion of said rod terminating into a plurality of closely packed helically formed loops, the size of said loops as a unit being sufficient to hook onto and freely hang from a connecting portion of an ionizer frame, the other end portion of said rod being also helically formed into a plurality of closely packed loops which are coupled as a unit to an end loop of a helically and tightly wound coil spring of a heat-resistant alloy, said tightly wound coil spring comprising a plurality of active turns, with each active turn adjacently touching the other in the unstretched condition, the coil spring being cylindrically shaped and having a length such as to provide a tension on the ionizer wire of at least about 30 pounds when substantially the total length of the cylindrical coil is activated by stretching to provide and maintain said tension, said coil spring having a connecting loop at its other end for coupling to an opposite portion of said ionizer frame.

2. The ionizer wire rod construction of claim 1, wherein said wire rod has a diameter of about 0.05 to 0.125 inch, and wherein wire of said coil spring has a diameter of about 0.05 to 0.125 inch and the spring has a stretch rate of about 3 to 10 pounds per inch of original coil length when stretched, the helically formed loops at the end of the rod including a free tail portion which is bent around said wire rod adjacent to said loops.

3. The ionizer wire rod construction of claim 2, wherein said cylindrical coil spring has a diameter of about $\frac{1}{2}$ to $1\frac{1}{4}$ inch, and wherein the total stress on each of said ionizer wires when the spring is stretched ranges from about 30 to 50 pounds.

4. The ionizer wire rod construction of claims 2 or 3, wherein the stretch rate of the coil spring ranges from about 4 to 6 pounds per inch of original coil length when the spring is stretched, and wherein the total stress on said ionizer wire rods ranges from about 35 to 45 pounds.

5. The ionizer wire rod and coil spring of claim 1, wherein the heat resistant alloy is selected from the group consisting of nickel-base and iron-base heat resistant alloys.

6. The ionizer wire rod of claim 5, wherein the heat resistant alloy is stainless steel.

7. The ionizer wire of claim 6, wherein the stainless steel is a Type 316 stainless consisting essentially by weight of about 16% to 18% Cr, about 10% to 14% Ni, about 2% to 3% Mo, and the balance essentially iron.

8. An electrostatic precipitator comprising a housing with inlet and exit means for receiving and discharging gas, said electrostatic precipitator comprising, a plurality of spaced vertically extending collector plates mounted in said housing in substantially parallel relationship, said plates being electrically grounded, a plurality of ionizer wire frames each mounted between said collector plates and characterized by a top and a bottom frame portion and each having a spaced array of vertically extending ionizer wire rods of a heat resistant alloy, said frames being coupled for electrical excitation opposite in charge to said grounded collector plates, each of said wire rods having connecting means at each end thereof in the form of a plurality of tightly wound closely packed helically formed loops, one end of said wire rod being coupled via said loops as a unit to the top portion of each frame with the other end thereof coupled via said loops as a unit to one end of a helically tightly wound cylindrically shaped coil spring, which spring at its other end is freely coupled under tension to the bottom portion of said frame, the length of said coil spring and the diameter of the wire forming said spring being such as to provide a tension on the ionizer rod of at least about 30 pounds when substantially the total length of said helically wound coil spring is activated by stretching when coupled to said frame.

9. The electrostatic precipitator of claim 8, wherein said wire rod has a diameter of about 0.05 to 0.125 inch, and wherein the wire diameter of said helically and tightly wound tension spring ranges from about 0.05 to 0.125 inch and the spring has a stretch rate of about 3 to 10 pounds per inch of original coil spring length following stretching when mounted on said frames, the helically formed loops at the end of the rod including a free tail portion which is bent around said wire rod adjacent to said loops.

10. The electrostatic precipitator of claim 9, wherein said helically wound cylindrically-shaped coil spring has a diameter of about $\frac{1}{2}$ to $1\frac{1}{4}$ inch, and wherein the total stress on each of said ionizer wires when the spring is stretched ranges from about 30 to 50 pounds.

11. The electrostatic precipitator of claim 9 or 10, wherein the stretch rate of the spring ranges from about 4 to 6 pounds per inch of original spring length following stretching, and wherein the total stress on said ionizer wire rods ranges from about 35 to 45 pounds.

12. The electrostatic precipitator of claim 8, wherein said wire rods are made of a heat resistant alloy selected from the group consisting of nickel-base and iron-base heat resistant alloys.

13. The electrostatic precipitator of claim 12, wherein the heat resistant alloy is stainless steel.

14. The electrostatic precipitator of claim 13, wherein the stainless steel is a Type 316 stainless consisting essentially by weight of about 16% to 18% Cr, about 10% to 14% Ni, about 2% to 3% Mo and the balance essentially iron.

15. The electrostatic precipitator of claim 8 wherein each of said ionizer wire frames are sectioned to provide two sets of ionizer wire rods one above the other.

* * * * *